US005571647A

United States Patent [19]

Mishra et al.

[11] Patent Number: 5,571,647

[45] Date of Patent: Nov. 5, 1996

[54] ELECTROPHOTOGRAPHIC IMAGING MEMBER WITH IMPROVED CHARGE GENERATION LAYER

[75] Inventors: Satchidanand Mishra; Robert C. U. Yu, both of Webster; Kathleen M. Carmichael, Williamson; Edward F. Grabowski, Webster; Anthony M. Horgan, Pittsford; William W. Limburg, Penfield; Sharon E. Normandin, Macedon; Damodar M. Pai, Fairport; Richard L. Post, Penfield; Donald P. Sullivan, Rochester; Donald C. VonHoene, Fairport, all of N.Y.

[73] Assignee: Xerox Corporation, Stamford, Conn.

[21] Appl. No.: 587,119

[22] Filed: Jan. 11, 1996

[51] Int. Cl.[6] ..... G03G 5/14

[52] U.S. Cl. ..... 430/58; 430/64; 430/96

[58] Field of Search ..... 430/58, 59, 64, 430/96

[56] References Cited

U.S. PATENT DOCUMENTS

| | | | |
|---|---|---|---|
| 4,464,450 | 8/1984 | Teusehu | 430/59 |
| 4,587,189 | 5/1986 | Hor et al. | 430/59 |
| 4,588,667 | 5/1986 | Jones et al. | 430/73 |
| 4,780,385 | 10/1988 | Wielock et al. | 430/58 |
| 4,786,570 | 11/1988 | Yu et al. | 430/58 |
| 4,925,760 | 5/1990 | Baranyi et al. | 430/76 |
| 4,943,508 | 7/1990 | Yu | 430/58 |
| 5,019,473 | 5/1991 | Nguyen et al. | 430/58 |
| 5,322,755 | 6/1994 | Allen et al. | 430/96 |
| 5,418,100 | 5/1995 | Yu | 430/58 |

*Primary Examiner*—John Goodrow

[57] ABSTRACT

An electrophotographic imaging member comprising a support substrate having a two layered electrically conductive outer surface, a hole blocking layer, an adhesive layer comprising a copolyester resin, a charge generation layer comprising photoconductive perylene or phthalocyanine particles dispersed in a film forming resin binder blend comprising polyvinyl butyral copolymer and a copolyester selected from the group consisting of a first copolyester, a second copolyester and mixtures thereof, and a charge transport layer.

14 Claims, No Drawings

ELECTROPHOTOGRAPHIC IMAGING MEMBER WITH IMPROVED CHARGE GENERATION LAYER

BACKGROUND OF THE INVENTION

This invention relates in general to electrophotography and more specifically, to an improved electrophotographic imaging member having improved charge generation layers and process for using the imaging member.

In the art of electrophotography, an electrophotographic plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members are usually multilayered photoreceptors that comprise a substrate support, an electrically conductive layer, an optional hole blocking layer, an adhesive layer, a charge generating layer, and a charge transport layer in either a flexible belt form or a rigid drum configuration. For most multilayered flexible photoreceptor belts, an anti-curl layer is usually employed on the back side of the substrate support, opposite to the side of the electrically active layers, to render the desired photoreceptor flatness. One type of multilayered photoreceptor comprises a layer of finely divided particles of a photoconductive inorganic compound dispersed in an electrically insulating organic resin binder. U.S. Pat. No. 4,265,990 discloses a layered photoreceptor having separate charge generating (photogenerating) and charge transport layers. The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive material may be formed as a continuous, homogeneous photogenerating layer. Many suitable photogenerating materials known in the art can be utilized, if desired.

As more advanced, higher speed electrophotographic copiers, duplicators and printers were developed, degradation of image quality was encountered during extended cycling. Moreover, complex, highly sophisticated, duplicating and printing systems employed flexible photoreceptor belts, operating at very high speeds, have also placed stringent mechanical requirements and narrow operating limits as well on photoreceptors. For example, the layers of many modern multilayered photoreceptor belt must be highly flexible, adhere well to each other, and exhibit predictable electrical characteristics within narrow operating limits to provide excellent toner images over many thousands of cycles.

A typical prior art multilayered flexible photoreceptor configuration comprising an adhesive interface layer between the hole blocking layer and the adjacent photogenerating layer to improve adhesion or to act as an electrical barrier layer, is disclosed, for example, in U.S. Pat. No. 4,780,385. Typical adhesive interface layers disclosed in U.S. Pat. No. 4,780,385 include film-forming polymers such as polyester, polyvinylbutyral, polyvinylpyrolidone, polyurethane, polycarbonates polymethylmethacrylate, mixtures thereof, and the like. Specific polyester adhesive materials are disclosed, for example in U.S. Pat. No. 4,786,570 where linear saturated copolyesters consisting of alternating monomer units of ethylene glycol and four randomly sequenced diacids and copolyesters of diacids and diols where the diacid is selected from the group consisting of terephthalic acid, isophthalic acid, adipic acid, azelaic acid, and mixtures thereof and the diol is selected from the group consisting of ethylene glycol, 2,2-dimethyl propane diol and mixtures thereof. The entire disclosure of U.S. Pat. No. 4,786,570 is incorporated herein by reference.

An encouraging advance in electrophotographic imaging which has emerged in recent years is the successful fabrication of a flexible imaging member which exhibits excellent capacitive charging characteristic, outstanding photosensitivity, low electrical potential dark decay, and long term electrical cyclic stability. This imaging member employed in belt form usually comprises a substrate, a conductive layer, a solution coated hole blocking layer, a solution coated adhesive layer, a thin charge generating layer comprising a sublimation deposited perylene or phthalocyanine organic pigment or a dispersion of one of these pigments in a selected binder resin, a solution coated charge transport layer, a solution coated anti-curl layer, and an optional overcoating layer.

Multi-layered photoreceptors containing charge generating layers, comprising either vacuum sublimation deposited pure organic pigment or an organic pigment dispersion of perylene or phthalocyanine in a resin binder, have frequently been found to have undesirable characteristics such as forming charge deficient spots which are visible in the final hard copy print. Photoreceptors containing perylene pigments in the charge generating layers, particularly benzimidazole perylene dispersion charge generating layers, have a spectral sensitivity of up to 720 nanometers, are highly compatible with exposure systems utilizing visible laser diodes, exhibit low dark decay electrical characteristic and reduced background/residual voltages. These characteristics are superior to photoreceptor counterparts containing a trigonal selenium dispersion in the charge generating layer. Unfortunately, these multi-layered benzimidazole perylene photoreceptors have also been found to develop a serious charge deficient spots problem, particularly the dispersion of perylene pigment in the matrix of a bisphenol Z type polycarbonate film forming binder. The expression "charge deficient spots" as employed herein is defined as localized areas of dark decay that appear as toner deficient spots when using charged area development, e.g. appearance of small white spots having an average size of between about 0.2 and about 0.3 millimeter on a black toner background on an imaged hard copy. In discharged area development systems, the charge deficient spots appear in the output copies as small black toner spots on a white background. Moreover, multi-layered benzimidazole perylene photoreceptors have also been noted to yield low adhesion bond strength at the contacting surfaces between the charge generating layer and the adhesive interface layer, causing undesirable premature photoreceptor layer delamination during photoreceptor image cycling in copiers, duplicators and printers. In a customer service environment, premature photoreceptor layer delamination requires costly and frequent photoreceptor belt replacement by skilled technical representatives.

Typically, flexible photoreceptor belts are fabricated by depositing the various layers of photoactive coatings onto long webs which are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise and thereafter transversely cut into predetermined length to form photoreceptor sheets of precise dimensions that are eventually welded into belts. When multi-layered photoreceptors containing perylene pigment dispersion in the charge generating layer are slit lengthwise during the belt fabrication process, it has been found that some of the photoreceptor delaminates and becomes unusable. In the fabricated belt form, photoreceptor layer delamination at the welded seam, due to stress concentration development at the double thickness overlap area during dynamic fatigue photoreceptor belt bending/flexing over the machine belt support rollers, diminishes the practical application value of the belt. All of the above deficiencies, implicated by the low layer adhesion bond strength, hinder slitting of a photoreceptor web through the charge generating layer without encountering edge delamination. Slitting is used to transversely cut webs into sheets for welding into belts and also to longitudinally slice double wide coated photoreceptor webs into multiple narrower charge generating layers.

In general, photoconductive pigment loadings of 80 percent by volume in a binder resin or a mixed resins binder are highly desirable in the photogenerating layer to provide excellent photosensitivity. However, these dispersions are highly unstable to extrusion coating conditions, resulting in numerous coating defects that generate a large number of unacceptable material that must be scrapped when using extrusion coating of a dispersion of pigment in organic solution of polymeric binder. More stable dispersions can be obtained by reducing the pigment loading to 30–40 percent by volume, but in most cases the resulting "diluted" photogenerating layer could not provide adequate photosensitivity. Also, the dispersions of higher pigment loadings generally provided a generator layer with poor to adequate adhesion to either the underlying ground plane or adhesive layer, or the overlying transport layer when polyvinylbutyral binders are utilized in the charge generating layer. Many of these organic dispersions are quite unstable with respect to pigment agglomeration, resulting in dispersion settling and the formation of dark streaks and spots of pigment during the coating process. Normally, the polymeric binders which produce the best (most stable, therefore most manufacturable) dispersion suffer from deficiencies either in xerographic or mechanical properties, while the least stable dispersions provided the best possible mechanical and xerographic properties. The best compromise of manufacturability and xerographic/mechanical performance is obtained by use of a photogenerating layer containing benzimidazole perylene pigment dispersed in a bisphenol Z type polycarbonate film forming binder. However, when a polyester adhesive layer is employed in a photoreceptor in combination with a photogenerating layer containing benzimidazole perylene pigment dispersed in a bisphenol A type or a bisphenol Z type polycarbonate film forming binder, poor adhesion between the charge generator layer and the adhesive layer can cause spontaneous photoreceptor delaminate during certain slitting operations, during fabrication, or during extensive photoreceptor belt cycling over small diameter machine belt support rollers.

In addition, when a multilayered belt imaging member containing benzimidazole perylene pigment dispersed in the bisphenol Z polycarbonate film forming binder in the charge generating layer is fabricated by ultrasonic welding the opposite ends of an imaging sheet together, delamination is encountered when attempts are made to grind away some of the weld splash material. Removal of the weld splash material is of particular important, because it allows the elimination of seams which form flaps during electrophotographic imaging and cleaning processes of belt function that causes the initiation of toner particles trapping and thereafter release them as unwanted dirts over the imaging belt surface to result in copy black spot print defects. Also, the inability to grind, buff, or polish a welded seam causes reduced cleaning blade life as well as seam interference with toner image ultrasonic transfer assist subsystems.

In U.S. Pat. No. 5,322,755 a layered photoconductive imaging member is disclosed comprising a supporting substrate, a photogenerator layer comprising perylene photoconductive pigments dispersed in a resin binder mixture comprising at least two polymers, and a charge transport layer. The resin binder can be, for example, a mixture of polyvinylcarbazole and polycarbonate homopolymer or a mixture of polyvinylcarbazole, polyvinylbutyral and polycarbonate homopolymer or a mixture of polyvinylcarbazole and polyvinylbutyral or a mixture of polyvinylcarbazole and a polyester. Although improvement in photosensitivity and adhesion are achieved, charge deficient spots print defects can still be a problem.

Thus, there is a continuing need for improved photoreceptors that exhibit freedom from charge deficient spots and are more resistant to layer delamination during slitting, grinding, buffing, polishing, and dynamic belt image cycling.

INFORMATION DISCLOSURE STATEMENT

U.S. Pat. No. 5,322,755 to Allen et al., issued on Jun. 21, 1994—A layered photoconductive imaging member is disclosed comprising a supporting substrate, a photogenerator layer comprising perylene photoconductive pigments dispersed in a resin binder mixture comprising at least two polymers, and a charge transport layer. The resin binder can be, for example, a mixture of polyvinylcarbazole and polycarbonate homopolymer or a mixture of polyvinylcarbazole, polyvinylbutyral and polycarbonate homopolymer or a mixture of polyvinylcarbazole and polyvinylbutyral or a mixture of polyvinylcarbazole and a polyester.

U.S. Pat. No. 5,418,100 to Yu, issued May 23, 1995—Discloses an electrophotographic imaging device fabrication method, in which the solvent used to coat charge transport layer is a solvent to which an underlying adhesive interface layer is substantially insensitive. The charge generating layer used for the imaging device is vacuum sublimation deposited benzimidazole perylene pigment and the adhesive interface layer may, for example, be formed of cross-linked film-forming polymers which are insoluble in a solvent used to apply the charge transport layer.

U.S. Pat. No. 4,925,760 to Baranyi et al., issued May 15, 1990—A layered photoresponsive imaging member is disclosed comprising a supporting substrate, a vacuum evaporated photogenerating layer comprised of certain pyranthrone pigments including tribromo-8,16-pyranthrenedione and trichloro-8,16-pyranthrenedione; and an aryl amine hole transport layer comprised of molecules of a certain designated formula dispersed in a resinous binder.

U.S. Pat. No. 4,780,385 to Wieloch et al., issued Oct. 25, 1988—An electrophotographic imaging member is disclosed having an imaging surface adapted to accept a negative electrical charge, the electrophotographic imaging member comprising a metal ground plane layer comprising zirconium, a hole blocking layer, a charge generation layer comprising photoconductive particles dispersed in a film forming resin binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 4,786,570 to Yu et al., issued Nov. 22, 1988—A flexible electrophotographic imaging member is disclosed which comprises a flexible substrate having an electrically conductive surface, a hole blocking layer comprising an aminosilane reaction product, an adhesive layer having a thickness between about 200 angstroms and about 900 angstroms consisting essentially of at least one copolyester resin having a specified formula derived from diacids selected from the group consisting of terephthalic acid, isophthalic acid, and mixtures thereof and a diol comprising ethylene glycol, the mole ratio of diacid to diol being 1:1, the number of repeating units equaling a number between about 175 and about 350 and having a $T_g$ of between about 50° C. to about 80° C., the aminosilane also being a reaction product of the amino group of the silane with the —COOH and —OH end groups of the copolyester resin, a charge generation layer comprising a film forming polymeric component, and a diamine hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. Processes for fabricating and using the flexible electrophotographic imaging member are also disclosed.

U.S. Pat. No. 5,019,473 to Nguyen et al., issued May 28, 1991—An electrophotographic recording element is disclosed having a layer comprising a photoconductive perylene pigment, as a charge generation material, that is sufficiently finely and uniformly dispersed in a polymeric binder to provide the element with excellent electrophotographic speed. The perylene pigments are perylene-3,4,9, 10-tetracarboxylic acid imide derivatives.

U.S. Pat. No. 4,587,189 to Hor et al., issued May 6, 1986—Disclosed is an improved layered photoresponsive imaging member comprised of a supporting substrate; a vacuum evaporated photogenerator layer comprised of a perylene pigment selected from the group consisting of a mixture of bisbenzimidazo(2,1-a-1',2'-b)anthra(2,1,9-def:6, 5,10 -d'e'f')diisoquinoline-6,11-dione, and bisbenzimidazo(2,1-a:2',1'-a)anthra( 2,1,9-def:6,5,10-d'e'f')diisoquinoline-10,21-dione, and N,N'-diphenyl-3,4,9, 10-perylenebis(dicarboximide); and an aryl amine hole transport layer comprised of molecules of a specified formula dispersed in a resinous binder.

U.S. Pat. No. 4,588,667 to Jones et al., issued May 13, 1986—An electrophotographic imaging member is disclosed comprising a substrate, a ground plane layer comprising a titanium metal layer contiguous to the substrate, a charge blocking layer contiguous to the titanium layer, a charge generating binder layer and a charge transport layer. This photoreceptor may be prepared by providing a substrate in a vacuum zone, sputtering a layer of titanium metal on the substrate in the absence of oxygen to deposit a titanium metal layer, applying a charge blocking layer, applying a charge generating binder layer and applying a charge charge transport layer. If desired, an adhesive layer may be interposed between the charge blocking layer and the photoconductive insulating layer.

U.S. Pat. No. 4,943,508 to Yu, issued Jul. 24, 1990—A process for fabricating an electrophotographic imaging member is disclosed which involves providing an electrically conductive layer, forming an aminosilane reaction product charge blocking layer on the electrically conductive layer, extruding a ribbon of a solution comprising an adhesive polymer dissolved in at least a first solvent on the electrically conductive layer to form a wet adhesive layer, drying the adhesive layer to form a dry continuous coating having a thickness between about 0.08 micrometer (800 angstroms) and about 0.3 micrometer (3,000 angstroms), applying to the dry continuous coating a mixture comprising charge generating particles dispersed in a solution of a binder polymer dissolved in at least a second solvent to form a wet generating layer, the binder polymer being miscible with the adhesive polymer, drying the wet generating layer to remove substantially all of the second solvent, and applying a charge transport layer, the adhesive polymer consisting essentially of a linear saturated copolyester reaction product of ethylene glycol and four diacids wherein the diol is ethylene glycol, the diacids are terephthalic acid, isophthalic acid, adipic acid and azelaic acid, the sole ratio of the terephthalic acid to the isophthalic acid to the adipic acid to the azelaic acid is between about 3.5 and about 4.5 for terephthalic acid; between about 3.5 and about 4.5 isophthalic acid; between about 0.5 and about 1.5 for adipic acid; between about 0.5 and about 1.5 for azelaic acid, the total moles of diacid being in a mole ratio of diacid to ethylene glycol in the copolyester of 1:1, and the $T_g$ of the copolyester resin being between about 32° C. about 50° C.

U.S. Pat. No. 4,464,450 to Teuscher, issued Aug. 7, 1984—An electrostatographic imaging member is disclosed having two electrically operative layers including a charge transport layer and a charge generating layer, the electrically operative layers overlying a siloxane film coated on a metal oxide layer of a metal conductive anode, said siloxane film comprising a reaction product of a hydrolyzed silane having a specified general formula.

CROSS REFERENCE TO RELATED APPLICATIONS

This application is related to the following U.S. patent applications:

U.S. patent application Ser. No. 08/587120 (Attorney Docket No. D/94852), filed concurrently herewith in the names of Satchidanand Mishra et al., entitled "MULTILAYERED PHOTORECEPTOR WITH ADHESIVE AND INTERMEDIATE LAYERS"—An electrophotographic imaging member is disclosed including a support substrate having an electrically conductive ground plane layer comprising a layer comprising zirconium over a layer comprising titanium a hole blocking layer, an adhesive layer comprising a polyester film forming resin, an intermediate layer in contact with the adhesive layer, the intermediate layer comprising a carbazole polymer, a charge generation layer comprising a perylene or a phthalocyanine, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. patent application Ser. No. 08/587121 (Attorney Docket No. D/95066), filed concurrently herewith in the names of Satchidanand Mishra et al., entitled "ELECTROPHOTOGRAPHIC IMAGING MEMBER WITH IMPROVED UNDERLAYER"—An electrophotographic imaging member is disclosed comprising a support substrate having an electrically conductive ground plane layer comprising a layer comprising zirconium over a layer comprising titanium, a hole blocking layer, an adhesive layer comprising a polymer blend comprising a carbazole polymer and a thermoplastic resin selected from the group consisting of copolyester, polyarylate and polyurethane in contiguous contact with said hole blocking layer, a charge generation layer comprising a perylene or a phthalocyanine in contiguous contact with said adhesive layer, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. patent application Ser. No. 08/587118 (Attorney Docket No. D/93644), filed concurrently herewith in the name of Robert C. U. Yu, entitled "MULTILAYERED ELECTROPHOTOGRAPHIC IMAGING MEMBER WITH VAPOR DEPOSITED GENERATOR LAYER AND IMPROVED ADHESIVE LAYER"—An electrophotographic imaging member IS disclosed comprising an electrophotographic imaging member comprising a substrate layer having an electrically conductive outer surface, an adhesive layer comprising a thermoplastic polyurethane film forming resin, a thin vapor deposited charge generating layer consisting essentially of a thin homogeneous vacuum sublimation deposited film of an organic photogenerating pigment, and a charge transport layer, the transport layer being substantially non-absorbing in the spectral region at which the charge generation layer generates and injects photogenerated holes but being capable of supporting the injection of photogenerated holes from the charge generation layer and transporting the holes through the charge transport layer.

U.S. patent application Ser. No. 08/586470 (Attorney Docket No. D/95064), filed concurrently herewith in the name of Robert C. U. Yu et al., entitled "PHOTORECEPTOR WHICH RESISTS CHARGE DEFICIENT SPOTS"—An electrophotographic imaging member comprising a support substrate having an electrically conductive ground plane layer comprising a layer comprising zirconium over a layer comprising titanium, a hole blocking layer, an adhesive layer comprising a thermoplastic polyurethane film forming resin, a charge generation layer comprising perylene or a phthalocyanine particles dispersed in a polycarbonate film forming binder, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. patent application Ser. No. 08/586469 (Attorney Docket No. D/95068), filed concurrently herewith in the name of Satchidanand Mishra et al., entitled "IMPROVED CHARGE GENERATION LAYER IN AN ELECTROPHOTOGRAPHIC IMAGING MEMBER"—An electrophotographic imaging member is disclosed comprising a support substrate having an electrically conductive ground plane layer comprising a layer comprising zirconium over a layer comprising titanium, a hole blocking layer, an adhesive layer comprising a polyester film forming resin, an intermediate layer in contact with the adhesive layer, the intermediate layer comprising a carbazole polymer, a charge generation layer comprising perylene or a phthalocyanine particles dispersed in a polymer binder blend of polycarbonate and carbazole polymer, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

SUMMARY OF THE INVENTION

It is, therefore, an object of the present invention to provide an improved photoreceptor member which overcomes the above-noted disadvantages.

It is yet another object of the present invention to provide an improved electrophotographic member having a charge genration layer which imparts to the member greater resistance to the formation of charge deficient spots during image cycling.

It is a further object of the present invention to provide a photoconductive imaging member which enables successful slitting a wide web lengthwise through a charge generation layer comprising benzimidazole perylene dispersed in a matrix of polyvinyl butyral copolymer blended with one or two copolyesters.

It is still yet another object of the present invention to provide an improved electrophotographic member having an charge genration layer which adheres well to an adhesive layer.

It is still another object of the present invention to provide an electrophotographic imaging member having welded seams that can be buffed or ground without causing layer delamination.

It is another object of the present invention to provide an electrophotographic imaging member which inhibits charge deficient spot formation as well as having a photoresponse to a visible light diode.

The foregoing objects and others are accomplished in accordance with this invention by providing an electrophotographic imaging member comprising a support substrate having a two layered electrically conductive outer surface, a hole blocking layer, an adhesive layer comprising a copolyester resin, a charge generation layer comprising photoconductive perylene or phthalocyanine particles dispersed in a film forming resin binder blend, said resin binder blend comprising polyvinyl butyral copolymer represented by the following general formula:

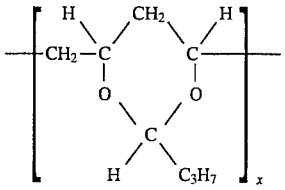

polyvinyl butyral

-continued

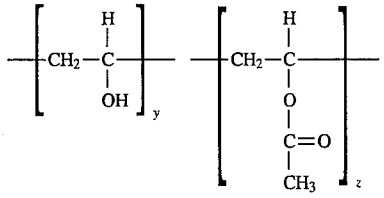

polyvinyl alcohol — polyvinyl acetate wherein:

x is a number such that the polyvinyl butyral content is between about 50 and about 75 mol percent, y is a number such that the polyvinyl alcohol content is between about 12 and about 50 mol percent, and z is a number such that the polyvinyl acetate content is between about 0 to 15 mol percent, and a copolyester selected from the group consisting of a first copolyester represented by the following general formula:

$$\overset{O}{\overset{\|}{HOC}}\text{-[diacid-diol]}_n\text{-OH}$$

wherein said diacid is selected from the group consisting of terephthalic acid, isophthalic acid, and mixtures thereof, said diol comprises ethylene glycol and 2,2-dimethyl propane diol, said mole ratio of diacid to diol is 1:1, said mole ratio of terephthalic acid to isophthalic acid is 1.2:1, said mole ratio of ethylene glycol to 2,2-dimethyl propane diol is 1.33:1, n is a number between about 160 and about 330, and the $T_g$ of said copolyester resin is between about 50° C. and about 80° C., a second copolyester represented by the following general formula:

$$\overset{O}{\overset{\|}{HOC}}\text{-[diacid-ethylene glycol]}_m\text{-OH}$$

and mixtures of said first copolyester and said second copolyester, and a charge transport layer, said charge transport layer being substantially non-absorbing in the spectral region at which the charge generation layer generates and injects photogenerated holes but being capable of supporting the injection of photogenerated holes from said charge generation layer and transporting said holes through said charge transport layer. This photoreceptor is utilized in an electrophotographic imaging process.

The substrate may be opaque or substantially transparent and may comprise numerous suitable materials having the required mechanical properties. Accordingly, this substrate may comprise a layer of an electrically non-conductive or conductive material such as an inorganic or an organic composition. As electrically non-conducting materials there may be employed various thermoplastic and thermoset resins known for this purpose including polyesters, polycarbonates, polyamides, polyurethanes, and the like or metals such as aluminum, nickel, steel, stainless steel, titanium, chromium, copper, brass, tin, and the like. The substrate may have any suitable shape such as, for example, a flexible web, rigid cylinder, sheet and the like. Preferably, the substrate support is in the form of an endless flexible belt.

The thickness of a flexible substrate support depends on numerous factors, including economical considerations, and thus this layer for a flexible belt may be of substantial thickness, for example, over 200 micrometers, or of minimum thickness less than 50 micrometers, provided there are no adverse affects on the final photoconductive device. In one flexible belt embodiment, the thickness of this layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers.

The zirconium and/or titanium layer may be formed by any suitable coating technique, such as vacuum deposition. Typical vacuum depositing techniques include sputtering, magnetron sputtering, RF sputtering, and the like. Magnetron sputtering of zirconium or titanium onto a metallized substrate can be effected by a conventional type sputtering module under vacuum conditions in an inert atmosphere such as argon, neon, or nitrogen using a high purity zirconium or titanium target. The vacuum conditions are not particularly critical. In general, a continuous zirconium or titanium film can be attained on a suitable substrate, e.g. a polyester web substrate such as Mylar available from E. I. du Pont de Nemours & Co. with magnetron sputtering. It should be understood that vacuum deposition conditions may all be varied in order to obtain the desired zirconium or titanium thickness. Typical techniques for forming the zirconium and titanium layers are described in U.S. Pat. No. 4,780,385 and 4,588,667, the entire disclosures of which are incorporated herein in their entirety.

The conductive layer comprises a plurality of metal layers with the outermost metal layer (i.e. the layer closest to the charge blocking layer) comprising at least 50 percent by weight of zirconium. At least 70 percent by weight of zirconium is preferred in the outermost metal layer for even better results. The multiple layers may, for example, all be vacuum deposited or a thin layer can be vacuum deposited over a thick layer prepared by a different techniques such as by casting. Thus, as an illustration, a zirconium metal layer may be formed in a separate apparatus than that used for previously depositing a titanium metal layer or multiple layers can be deposited in the same apparatus with suitable partitions between the chamber utilized for depositing the titanium layer and the chamber utilized for depositing zirconium layer. The titanium layer may be deposited immediately prior to the deposition of the zirconium metal layer. Generally, for rear erase exposure, a conductive layer light transparency of at least about 15 percent is desirable. The combined thickness of the two layered conductive layer should be at between about 120 and about 300 angstroms. A typical zirconium/titanium dual conductive layer has a total combined thickness of about 200 angstroms. Although thicker layers may be utilized, economic and transparency considerations may affect the thickness selected.

Regardless of the technique employed to form the zirconium and/or titanium layer, a thin layer of zirconium or titanium oxide forms on the outer surface of the metal upon exposure to air. Thus, when other layers overlying the zirconium layer are characterized as "contiguous" layers, it is intended that these overlying contiguous layers may, in fact, contact a thin zirconium or titanium oxide layer that has formed on the outer surface of the metal layer. If the zirconium and/or titanium layer is sufficiently thick to be self supporting, no additional underlying member is needed and the zirconium and/or titanium layer may function as both a substrate and a conductive ground plane layer. Ground planes comprising zirconium tend to continuously oxidize during xerographic cycling due to anodizing caused by the passage of electric currents, and the presence of this oxide layer tends to decrease the level of charge deficient spots with xerographic cycling. Generally, a zirconium layer thickness of at least about 100 angstroms is desirable to maintain optimum resistance to charge deficient spots during xerographic cycling. A typical electrical conductivity for conductive layers for electrophotgraphic imaging members in slow speed copiers is about $10^2$ to $10^3$ ohms/square.

After deposition of the zirconium an/or titanium metal layer, a hole blocking layer is applied thereto. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with charge a generating layer over a charge (hole) transport layer. For negatively charged photoreceptors, any suitable hole blocking layer capable of forming an electronic barrier to holes between the adjacent photoconductive layer and the underlying zirconium and/or titanium layer may be utilized. A hole blocking layer may comprise any suitable material. Typical hole blocking layers utilized for the negatively charged photoreceptors may include, for example, Luckamide, hydroxy alkyl methacrylates, nylons, gelatin, hydroxyl alkyl cellulose, organopolyphosphazines, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the zirconium and/or titanium oxide layer which inherently forms on the surface of the metal layer when exposed to air after deposition. This combination reduces spots at time 0 and provides electrical stability at low RH. The imaging member is prepared by depositing on the zirconium and/or titanium oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450 to L. A. Teuscher, the disclosure of thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms–3000 Angstroms) is preferred because charge neutralization after the exposure step is facilitated and optimum electrical performance is achieved. A thickness of between about 0.03 micrometer and about 0.06 micrometer is preferred for zirconium and/or titanium oxide layers for optimum electrical behavior and reduced charge deficient spot occurrence and growth.

Any suitable adhesive copolyester interface layer may be applied to the charge blocking layer. Any suitable adhesive copolyester layer may be utilized. Adhesive copolyester layer materials are well known in the art. Typical adhesive polyester layer materials include, for example, polyesters, MOR-ESTER 49,000 (available from Morton International Inc.), Vitel PE-100, Vitel PE-200, Vitel PE-200D, and Vitel PE- 222 (all Vitels available from Goodyear Tire and Rubber Co.), and the like. The MOR-ESTER 49000 polyester resin is a linear saturated copolyester reaction product of ethylene glycol with terephthalic acid, isophthalic acid, adipic acid and azelaic acid. Other polyester resins which are chemically similar to the 49000 polyester resin and which are also suitable for a photoreceptor adhesive layer coating include Vitel PE-100 and Vitel PE-200, both of which which are available from Goodyear Tire & Rubber Co. Any suitable solvent or solvent mixtures may be employed to form a coating solution. Typical solvents include tetrahydrofuran, toluene, methylene chloride, cyclohexanone, and the like, and mixtures thereof. Satisfactory results may be achieved with a dry adhesive layer thickness between about 0.05 micrometer and about 0.3 micrometer. Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

The charge generating layer of the photoreceptor of this invention comprises a perylene pigment or a phthalocyanine pigment applied as a solution coated layer containing the pigment dispersed in a film forming resin binder blend. The perylene pigment is preferably benzimidazole perylene which is also referred to as bis(benzimidazole). This pigment exists in the cis and trans forms. The cis form is also called bisbenzimidazo( 2,1-a-1',1'-b) anthra (2,1,9-def:6,5, 10-d'e'f') disoquinoline- 6,11-dione. The trans form is also called bisbenzimidazo (2,1-a1',1'-b) anthra (2,1,9-def:6,5, 10-d'e'f') disoquinoline-10,21-dione. This pigment may be prepared by reacting perylene 3,4,9,10-tetracarboxylic acid dianhydride with 1,2-phenylene as illustrated in the following equation:

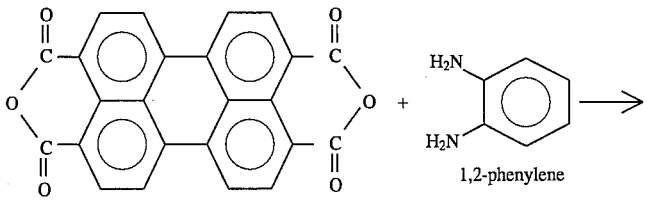

Perylene 3,4,9,10-tetracarboxylic acid dianhydride

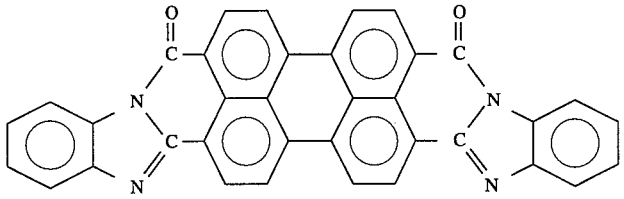

CIS bisbenzimidazo(2,1-a-1',1'-b)anthra(2,1,9-def:6,5,10-d'e'f')diisoquinoline-6,11-dione

+

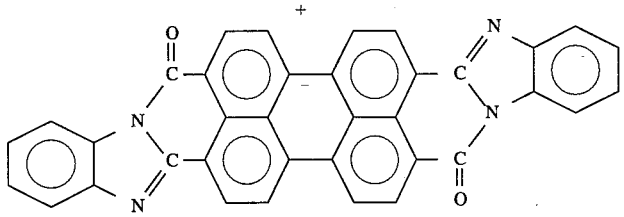

TRANS bisbenzimidazo(2,1-a-1',1'-b)anthra(2,1,9-def:6,5,10-d'e'f')diisoquinoline-10,21-dione Benzimidazole perylene is ground into fine particles having an average particle size of less than about 1 micrometer and dispersed in a the film forming binder blend. Optimum results are achieved with a pigment particle size between about 0.2 micrometer and about 0.3 micrometer. Benzimidazole perylene is described in U.S. Pat. No. 5,019,473 and U.S. Pat. No. 4,587,189, the entire disclosures thereof being incorporated herein by reference.

Although photoreceptor embodiments prepared with a charge generating layer comprising benzimidazole perylene dispersed in various types of resin binders give reasonably good results, the electrical life of the photoreceptor is found to be dramatically improved, particularly, with the use of benzimidazole perylene dispersed in a resin blend of a polyvinyl butyral and a copolyester. The polyvinyl copolymer is represented by the following general formula:

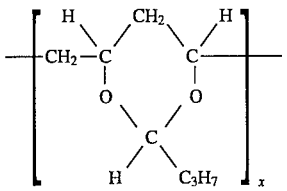

polyvinyl butyral

-continued

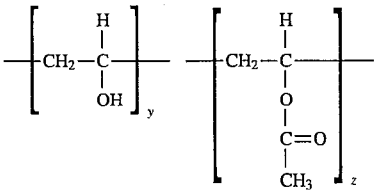

polyvinyl alcohol — polyvinyl acetate wherein:

x is a number such that the polyvinyl butyral content is between about 50 and about 75 mol percent, y is a number such that the polyvinyl alcohol content is between about 12 and about 50 mol percent, and z is a number such that the polyvinyl acetate content is between about 0 to 15 mol percent Preferably, the film forming polyvinyl butyral copolymer binder for the charge generating layer is the reaction product of a polyvinyl alcohol and butyraldehyde in the presence of a sulphuric acid catalyst. The hydroxyl groups of the polyvinyl alcohol react to give a random butyral structure which can be controlled by varying the reaction temperature and time. The acid catalyst is neutralized with potassium hydroxide. The polyvinyl alcohol is synthesized by hydrolyzing polyvinyl acetate. The resulting hydrolyzed polyvinyl alcohol may contain some polyvinyl acetate moieties. The partially or completely hydrolyzed polyvinyl alcohol is reacted with the butyraldehyde under conditions where some of the hydroxyl groups of the polyvinyl alcohol are reacted, but where some of the other hydroxyl groups of the polyvinyl alcohol remain unreacted. For utilization in the photoconductive layer of this invention the reaction product should have a polyvinyl butyral content of between about 50 percent and about 75 mol percent, a polyvinyl alcohol content of between about 12 mol percent and about 50 mol percent and a polyvinyl acetate content up to about 15 mol percent. These film forming polyvinyl butyral copolymer are commercially available and include, for example, Butvar B-79 resin (available from Monsanto Chemical Co.) having a polyvinyl butyral content of about 88 percent by weight, a polyvinyl alcohol content of 12 percent by weight and a polyvinyl acetate content of less than about 1.5 percent by weight, a weight average molecular weight of between about 50,000 and about 80,000; Butvar B-76 resin (available from Monsanto Chemical Co.) having a polyvinyl butyral content of about 80 percent by weight, a polyvinyl alcohol content of 19 percent by weight and a polyvinyl acetate content of less than about 2.5 percent by weight, a weight average molecular weight of between about 90,000 and about 120,000; and BMS resin (available from Sekisui Chemical) having a polyvinyl butyral content of about 72 percent, a vinyl acetate group content of about 5 weight percent, no polyvinyl acetate component and a weight average of molecular weight of about 93,000. Preferably, the weight average molecular weight of the polyvinyl butyral utilized in the process of this invention is between about 50,000 and about 250,000. Satisfactory results may be obtained with polyvinyl butyral copolymer having a weight average molecular weight between about 20,000 and about 400,000.

The solvent for the film forming polyvinyl butyral copolymer includes, for example, cyclohexanone or other suitable ketones such as methyl ethyl ketone or methyl iso-amyl ketone or mixtures thereof having a boiling point between 75° C. and about 160° C.

The copolyester resin component of the blend is selected from the group consisting of a first copolyester represented by the following general formula:

$$\mathrm{HOC\text{-}[diacid\text{-}diol]}_n\text{-}\mathrm{OH}$$

wherein said diacid is selected from the group consisting of terephthalic acid, isophthalic acid, and mixtures thereof, said diol comprises ethylene glycol and 2,2-dimethyl propane diol, said mole ratio of diacid to diol is 1:1, said mole ratio of terephthalic acid to isophthalic acid is 1.2:1, said mole ratio of ethylene glycol to 2,2-dimethyl propane diol is 1.33:1, n is a number between about 160 and about 330, and the $T_g$ of said copolyester resin is between about 50° C. and about 80° C., a second copolyester represented by the following general formula:

$$\mathrm{HOC\text{-}[diacid\text{-}ethylene\ glycol]}_m\text{-}\mathrm{OH}$$

and mixtures of the first copolyester and the second copolyester.

Preferably, the binder blend consists essentially of between about 10 percent and about 50 percent by weight of said polyvinyl butyral copolymer and between about 90 percent and about 50 percent by weight of the first copolyester. Alternatively, binder blend consisting essentially of between about 10 percent and about 50 percent by weight of said polyvinyl butyral copolymer and between about 90 percent and about 50 percent by weight of the second copolyester. The first copolyester and the second copolyester may be present in the blend in a weight ratio of the first copolyester to the second copolyester ranging from about 10/90 to about 90/10.

Satisfactory results may be achieved when the dried charge generating layer contains between about 20 percent and about 90 percent by volume benzimidazole perylene dispersed in the film forming resin blend based on the total volume of the dried charge generating layer. Preferably, the perylene pigment is present in an amount between about 30 percent and about 80 percent by volume. Optimum results are achieved with an amount between about 35 percent and about 45 percent by volume. The use of the polymer blend as the charge generating binder is preferred, because it allows a reduction in perylene pigment loading without an extreme loss in photosensitivity.

Any suitable organic solvent may be utilized to dissolve the film forming resin binder blend. Typical solvents include tetrahydrofuran, toluene, methylene chloride, and the like. Tetrahydrofuran is preferred because it has no discernible adverse effects on xerography and has an optimum boiling point to allow adequate drying of the generator layer during a typical slot coating process. Coating dispersions for the charge generating layer may be formed by any suitable technique using, for example, attritors, ball mills, Dynomills, paint shakers, homogenizers, microfluidizers, and the like.

Any suitable coating technique may be used to apply coatings. Typical coating techniques include slot coating, gravure coating, roll coating, spray coating, spring wound bar coating, dip coating, draw bar coating, reverse roll coating, and the like.

Any suitable drying technique may be utilized to solidify and dry the deposited coatings. Typical drying techniques include oven drying, forced air drying, infrared radiation drying, and the like.

Satisfactory results may be achieved with a dry charge generating layer thickness between about 0.3 micrometer and about 3 micrometers. Preferably, the charge generating layer has a dried thickness of between about 1.1 micrometers and about 2 micrometers. The photogenerating layer thickness is related to binder content. Thicknesses outside these ranges can be selected providing the objectives of the present invention are achieved. Typical charge generating layer thicknesses have an optical density of between about 1.7 and about 2.1.

Any suitable charge transport layer may be utilized. The active charge transport layer may comprise any suitable transparent organic polymer of non-polymeric material capable of supporting the injection of photogenerated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of illumination Thus, the active charge transport layer is a substantially non-photoconductive material which supports the injection of photogenerated holes from the generation layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

The charge transport layer forming mixture preferably comprises an aromatic amine compound. Typical aromatic amine compounds include triphenyl amines, bis and poly triarylamines, bis arylamine ethers, bis alkylarylamines and the like.

Examples of charge transporting aromatic amines for charge transport layers capable of supporting the injection of photogenerated holes of a charge generating layer and transporting the holes through the charge transport layer include, for example, triphenylmethane, bis(4 -diethylamine-2-methylphenyl)phenylmethane; 4'-4"-bis(diethylamino)- 2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 120,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. A dried thickness of between about 18 micrometers and about 35 micrometers is preferred with optimum results being achieved with a thickness between about 24 micrometers and about 29 micrometers.

Preferably, the charge transport layer comprises an arylamine small molecule dissolved or molecularly dispersed in a polycarbonate.

Other layers such as conventional ground strips comprising, for example, conductive particles disposed in a film forming binder may be applied to one edge of the photoreceptor in contact with the zirconium and/or titanium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by volume unless otherwise indicated.

COMPARATIVE EXAMPLE I

A photoconductive imaging member was prepared by providing a web of titanium and zirconium coated polyester (Melinex, available from ICI Americas Inc.) substrate having a thickness of 3 mils, and applying thereto, with a gravure applicator, a solution containing 50 grams 3-aminopropyltriethoxysilane, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 500 Angstroms.

An adhesive interface layer was then prepared by the applying a wet coating over the blocking layer, using a gravure applicator, containing 3.5 percent by weight based on the total weight of the solution of copolyester adhesive (49,000, available from Morton International Inc., previously available from E. I. du Pont de Nemours & Co.) in a 70:30 volume ratio mixture of tetrahydrofuran/cyclohexanone. The adhesive interface layer was then dried for about 5 minutes at 135° C. in the forced air drier of the coater. The resulting adhesive interface layer had a dry thickness of 620 Angstroms.

A 9 inch×12 inch sample was then cut from the web, and the adhesive interface layer was thereafter coated with a photogenerating layer (CGL) containing 40 percent by volume benzimidazole perylene and 60 percent by volume poly(4,4'-diphenyl-1,1'-cyclohexane carbonate). This photogenerating layer was prepared by introducing 0.3 grams of poly(4,4'-diphenyl-1,1'-cyclohexane carbonate) PCZ-200, available from Mitsubishi Gas Chem. and 48 ml of tetrahydrofuran into a 4 oz. amber bottle. To this solution was added 1.6 gram of benzimidazole perylene and 300 grams of ⅛ inch diameter stainless steel shot. This mixture was then placed on a ball mill for 96 hours. 10 grams of the resulting dispersion was added to a solution containing 0.547 grams of poly(4,4'-diphenyl-1,1'-cyclohexane carbonate) PCZ-200 and 6.14 grams of tetrahydrofuran. The resulting slurry was thereafter applied to the adhesive interface with a ½- mil gap Bird applicator to form a layer having a wet thickness of 0.5 mil. The layer was dried at 135° C. for 5 minutes in a forced air oven to form a dry thickness photogenerating layer having a thickness of about 1.2 micrometers.

This photogenerator layer was overcoated with a charge transport layer. The charge transport layer was prepared by introducing into an amber glass bottle in a weight ratio of a hole transporting molecule of 1:1 N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbenfabriken Bayer A.G. The resulting mixture was dissolved in methylene chloride to form a solution containing 15 percent by weight solids. This solution was applied on the photogenerator layer using a 3-mil gap Bird applicator to form a coating which upon drying had a thickness of 24 microns. During this coating process the humidity was equal to or less than 15 percent. The photoreceptor device containing all of the above layers was annealed at 135° C. in a forced air oven for 5 minutes and thereafter cooled to ambient room temperature.

After application of the charge transport layer coating, the imaging member spontaneous curled upwardly. An anti-curl coating was needed to impart the desired flatness to the imaging member. The anti-curl coating solution was prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle was then covered tightly and placed on a roll mill for about 24 hours until total dissolution of the polycarbonate and the copolyester is achieved. The anti-curl coating solution thus obtained was applied to the rear surface of the supporting substrate (the side opposite to the imaging layers) by hand coating using a 3 mil gap Bird applicator. The coated wet film was dried at 135° C. in an air circulation oven for about 5 minutes to produce a dry, 14 micrometer thick anti-curl layer and provide the desired imaging member flatness. The resulting photoconductive imaging member was used to serve as a control.

COMPARATIVE EXAMPLE II

A photoconductive imaging member was prepared as described in Comparative Example I, except that the charge generating layer used was a reformulated charge generating layer containing 60 percent by volume benzimidazole perylene and 40 percent by volume polyvinyl butyral copolymer (B-79, available from Monsanto Chemical Co.). This charge generating layer was prepared by introducing 0.45 grams polyvinyl butyral copolymer B-79 and 50 mls of tetrahydrofuran solvent into a 4 oz. amber bottle. To this solution was added 2.4 grams of benzimidazole perylene and 300 grams of ⅛ inch diameter stainless steel shot. This mixture was then placed on a ball mill for 96 hours. A 30 grams of the resulting dispersion was then added to a solution containing 0.47 gram of polyvinyl butyral copolymer B-79 and 7.15 grams of tetrahydrofuran solvent. The resulting slurry was thereafter applied to the adhesive interface with a ½ mil-gap Bird applicator to form a layer having a wet thickness of 0.5 mil. The layer was dried at 135° C. for 5 minutes in a forced air oven to form a dried thickness charge generating layer having a thickness of 1.2 micrometers. The fabricated imaging member was used to serve as a second control.

EXAMPLE III

A photoconductive imaging member was prepared as described in Comparative Example II, except that the charge generating layer was modified by bending a copolyester (Vitel PE-200, available from Goodyear Tire & Rubber Co.) with the polyvinyl butyral copolymer to form a mixed binder blend. This new charge generating layer contained 45 percent by volume of benzimidazole perylene and 55 percent by volume of a mixed binder blend, having a polyvinyl butyral copolymer B-79 to copolyester Vitel PE-200 volume ratio of 12/43 in the dried charge generating layer. This charge generating layer was prepared by introducing 0.45 gram polyvinyl butyral copolymer B-79, and 50 mls of tetrahydrofuran solvent into a 4 oz. amber bottle. To this solution was added 2.4 grams of benzimidazole perylene and 300 grams of ⅛ inch diameter stainless steel shot. This mixture was then placed on a ball mill for 96 hours. A 10 grams of the resulting dispersion was then added to a solution containing 0.366 gram of PE-200 and 5.67 grams of tetrahydrofuran solvent. The resulting slurry was thereafter applied onto the adhesive interface with a ½ mil-gap Bird applicator to form a layer having a wet thickness of 0.5 mil. The layer was dried at 135° C. for 5 minutes in a forced air oven to form a dried thickness photo charge generating layer having a thickness of 1.2 micrometers.

EXAMPLE IV

A photoconductive imaging member was prepared as described in Example III, except that the polyvinyl butyral copolymer B-79 to copolyester Vitel PE-200 volume ratio in the mixed binder of the charge generating layer was 20:35.

EXAMPLE V

A photoconductive imaging member was prepared as described in Example Ill, except that the polyvinyl butyral copolymer B-79 to copolyester Vitel PE-200 volume ratio in the mixed binder of the charge generating layer was 27.5:27.5.

EXAMPLE VI

The electrical properties of photoconductive imaging members of Comparative Examples I and II as well as Examples II through V were investigated with a xerographic testing scanner comprising a cylindrical aluminum drum having a diameter of 24.26 cm (9.55 inches), to evaluate their respective photoelectrical integrity. The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted photoreceptor samples. The sample charging time was 33 milliseconds. Both expose and erase lights were broad band white light (400–700 nm) outputs, each supplied by a 300 watt output Xenon arc lamp. The relative locations of the probes and lights are indicated in Table A below:

TABLE A

| ELEMENT | ANGLE (Degrees) | POSITION (mm) | DISTANCE FROM PHOTORECEPTOR (mm) |
|---|---|---|---|
| Charge | 0.0 | 0.0 | 18 (Pins)<br>12 (Shield) |
| Probe 1 | 22.50 | 47.9 | 3.17 |
| Expose | 56.25 | 118.8 | N.A. |
| Probe 2 | 78.75 | 166.8 | 3.17 |
| Probe 3 | 168.75 | 356.0 | 3.17 |

TABLE A-continued

| ELEMENT | ANGLE (Degrees) | POSITION (mm) | DISTANCE FROM PHOTORECEPTOR (mm) |
|---|---|---|---|
| Probe 4 | 236.25 | 489.0 | 3.17 |
| Erase | 258.75 | 548.0 | 125.00 |
| Probe 5 | 303.75 | 642.9 | 3.17 |

The test samples were first rested in the dark for at least 60 minutes to ensure achievement of equilibrium with the testing conditions at 40 percent relative humidity and 21° C. Each sample was then negatively charged in the dark to a development potential of about 900 volts. The charge acceptance of each sample and its residual potential after discharge by front erase exposure to 400 ergs/cm$^2$ were recorded. The test procedure was repeated to determine the photo induced discharge characteristic (PIDC) of each sample by different light energies of up to 20 ergs/cm$^2$.

The duplicate sets of photoconductive imaging members of Comparative Examples I and II and Examples II to V were again tested in a motionless scanner by Differential Increase In Dark Decay (DIDD) measurement technique for charge deficient spot (microdefect) levels. The test involved the following steps:

(a) providing at least a first electrophotographic imaging member having a known differential increase in dark decay value, the imaging member comprising an electrically conductive layer and at least one photoconductive layer, (b) repeatedly subjecting the at least one electrophotographic imaging member to cycles comprising electrostatic charging and light discharging steps, (c) measuring dark decay of the at least one photoconductive layer during cycling until the amount of dark decay reaches a crest value, (d) establishing with the crest value a first reference datum for dark decay crest value at an initial applied field between about 24 volts/micrometer and about 40 volts/micrometer, (e) establishing with the crest value a second reference datum for dark decay crest value at a final applied field between about 64 volts/micrometer and about 80 volts/micrometer, (f) determining the differential increase in dark decay between the first reference datum and the second reference datum for the first electrophotographic imaging member to establish a known differential increase in dark decay value, (g) repeatedly subjecting a virgin electrophotographic imaging member to aforementioned cycles comprising electrostatic charging and light discharging steps until the amount of dark decay reaches a crest value for the virgin which remains substantially constant during further cycling, (h) establishing with the crest value for the virgin electrophotographic imaging member a third reference datum for dark decay crest value at the same initial applied field employed in step (d), (i) establishing with the crest value for the virgin electrophotographic imaging member a fourth reference datum for dark decay crest value at the same final applied field employed in step (e), (j) determining the differential increase in dark decay between the third reference datum and the fourth reference datum to establish a differential increase in dark decay value for the virgin electrophotographic imaging member, and (k) comparing the differential increase in dark decay value of the virgin electrophotographic imaging member with the known differential increase in dark decay value to ascertain the projected microdefect levels of the virgin electrophotographic imaging member.

The motionless scanner is described in U.S. Pat. No. 5,175,503, the entire disclosure thereof being incorporated herein by reference. To conduct the DIDD and motionless scanner cycling tests described above, the photoreceptor sample was first coated with a gold electrode on the imaging surface. The sample was then connected to a DC power supply through a contact to the gold electrode. The sample was charged to a voltage by the DC power supply. A relay was connected in series with the sample and power supply. After 100 milliseconds of charging, the relay was opened to disconnect the power supply from the sample. The sample was dark rested for a predetermined time, then exposed to a light to discharge the surface voltage to the background level and thereafter exposed to more light to further discharge to the residual level. The same charge-dark and rest-erase cycle was repeated for a few cycles until a crest value of dark decay was reached. The sample surface voltage was measured with a non-contact voltage probe during this cycling period.

Additional duplicate sets of photoconductive imaging members of all the above Examples were also evaluated for adhesive properties using a 180° (reverse) peel test technique. The 180° peel strength was determined by cutting a minimum of five 0.5 inch×6 inches imaging member samples from each of these Examples. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape, 1.3 cm (½ inch) width Scotch® Magic Tape #810, available from 3M Company. At this condition, the anti-curl layer/substrate of the stripped segment of the test sample can easily be peeled away 180° from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer with the substrate by the width of the test sample.

Although the electrical properties obtained for the photoconductive imaging members of the two Comparative Examples and all the remaining Examples exhibited about equivalent photoelectrical characteristics, the imaging members of Comparative Example II and Examples III, IV, and V employed a charge generating layer containing a polyvinyl butyral copolymer B-79 (PVB) binder or a polymer bend having a mixture of polyvinyl butyral copolymer B-79 (PVB) and copolyester Vitel PE-200, as shown in the following Table B, gave reduced Charge deficient spots, as reflected in the reduction of DIDD values compared to the result obtained for the control imaging member counterpart of Comparative Example I.

TABLE B

| EXAMPLE | CGL BINDER | DIDD (VOLTS) | PEEL STRENGTH (GMS/CM) |
|---|---|---|---|
| I | PCZ | 415 | 5.6 |
| II | PVB | 162 | 1.3 |
| III | PVB/PE-200 | 203 | 20.1 |
| IV | PVB/PE-200 | 190 | 22.8 |
| V | PVB/PE-200 | 164 | 13.1 |

The data in the above table indicate that replacing the polymer binder poly(4,4'-diphenyl-1,1'-cyclohexane carbonate) PCZ-200 from the charge generating layer of the imaging member of Comparative Example I with polyvinyl butyral copolymer B-79, as described in Comparative Example II, though, could produce significant DIDD reduction, unfortunately the adhesion bond strength of the resulting imaging member was seen to drop from 5.6 grams/cm to a low value of only 1.3 grams/cm. This imaging member layer adhesion bond strength reduction had been implicated in spontaneous delamination of the imaging member belt during electrophotographic imaging cycling under machine service conditions. Moreover, the results listed in the table above also show that introduction of a compatible second polymer, such as copolyester Vitel PE-200 to blend with the polyvinyl butyral copolymer B-79 to form a mixed binder for the charge generating layer application, provides a robust mechanical effect to substantially improve the layer adhesion bond strength.

While the embodiment disclosed herein is preferred, it will be appreciated from this teaching that various alternative, modifications, variations or improvements therein may be made by those skilled in the art, which are intended to be encompassed by the following claims:

What is claimed is:

1. An electrophotographic imaging member comprising a support substrate having a two layered electrically conductive outer surface, a hole blocking layer, an adhesive layer comprising a copolyester resin, a charge generation layer comprising photoconductive perylene or phthalocyanine particles dispersed in a film forming resin binder blend, said resin binder blend comprising polyvinyl butyral copolymer represented by the following general formula:

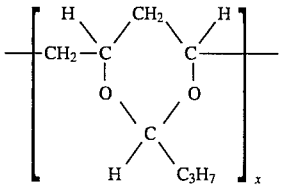

polyvinyl butyral

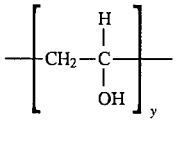

polyvinyl alcohol

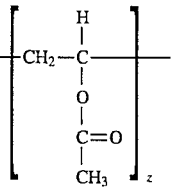

polyvinyl acetate wherein:

x is a number such that the polyvinyl butyral content is between about 50 and about 75 mol percent, y is a number such that the polyvinyl alcohol content is between about 12 and about 50 mol percent, and z is a number such that the polyvinyl acetate content is between about 0 to 15 mol percent, and a copolyester selected from the group consisting of a first copolyester represented by the following general formula:

$$\overset{O}{\overset{\|}{HOC}}\text{-[diacid-diol]}_n\text{-OH}$$

wherein said diacid is selected from the group consisting of terephthalic acid, isophthalic acid, and mixtures thereof, said diol comprises ethylene glycol and 2,2-dimethyl propane diol, said mole ratio of diacid to diol is 1:1, said mole ratio of terephthalic acid to isophthalic acid is 1.2:1, said mole ratio of ethylene glycol to 2,2-dimethyl propane diol is 1.33:1, n is a number between about 160 and about 330, and the $T_g$ of said copolyester resin is between about 50° C. and about 80° C., a second copolyester represented by the following general formula:

$$\overset{O}{\overset{\|}{HOC}}\text{-[diacid-ethylene glycol]}_m\text{-OH}$$

and mixtures of said first copolyester and said second copolyester, and a charge transport layer, said charge transport layer being substantially non-absorbing in the spectral region at which the charge generation layer generates and injects photogenerated holes but being capable of supporting the injection of photogenerated holes from said charge generation layer and transporting said holes through said charge transport layer.

2. An electrophotographic imaging member according to claim 1 wherein said binder blend consists essentially of between about 10 percent and about 50 percent by weight of said polyvinyl butyral copolymer and between about 90 percent and about 50 percent by weight of said first copolyester.

3. An electrophotographic imaging member according to claim 1 wherein said polyvinyl butyral copolymer has a weight average molecular weight between about 20,000 and about 400,000.

4. An electrophotographic imaging member according to claim 1 wherein said binder blend consisting essentially of between about 10 percent and about 50 percent by weight of said polyvinyl butyral copolymer and between about 90 percent and about 50 percent by weight of said second copolyester.

5. An electrophotographic imaging member according to claim 1 wherein said charge generation layer comprises between about 20 percent and about 90 percent by volume of said perylene pigment particles, based on the total weight of said charge generation layer.

6. An electrophotographic imaging member according to claim 1 wherein said conductive outer surface comprises a zirconium layer overlying a titanium layer, said zirconium layer having an oxidized outer surface.

7. An electrophotographic imaging member according to claim 6 wherein said two layered zirconium/titanium conductive outer surface has a thickness of between about 120 and about 300 Angstrom units.

8. An electrophotographic imaging member according to claim 1 wherein said support substrate comprises a flexible thermoplastic resin belt.

9. An electrophotographic imaging member according to claim 1 wherein said support substrate is a flexible metal belt.

10. An electrophotographic imaging member according to claim 1 wherein said blocking layer comprises an organoamino siloxane.

11. An electrophotographic imaging member according to claim 1 wherein said first copolyester and said second copolyester are present in said blend in a weight ratio of said first copolyester to said second copolyester ranging from about 10/90 to about 90/10.

12. An electrophotographic imaging member according to claim 11 wherein said binder blend consists essentially of between about 10 percent and about 50 percent by weight of said polyvinyl butyral and between about 90 percent and about 50 percent by weight of said copolyester blend.

13. An electrophotographic imaging member according to claim 1 wherein said support substrate is a rigid thermoplastic resin drum.

14. An electrophotographic imaging member according to claim 1 wherein said support substrate is a rigid metal drum.

* * * * *